US010833423B2

(12) United States Patent
Brigham

(10) Patent No.: US 10,833,423 B2
(45) Date of Patent: Nov. 10, 2020

(54) DUAL POLARIZED NOTCH ANTENNA HAVING LOW PROFILE STRIPLINE FEED

(71) Applicant: Massachusetts Institute of Technology, Cambridge, MA (US)

(72) Inventor: Glenn A. Brigham, Chelmsford, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 149 days.

(21) Appl. No.: 16/288,986

(22) Filed: Feb. 28, 2019

(65) Prior Publication Data

US 2020/0280140 A1 Sep. 3, 2020

(51) Int. Cl.

| | |
|---|---|
| ***H01Q 21/22*** | (2006.01) |
| ***H01Q 21/00*** | (2006.01) |
| ***H01Q 13/18*** | (2006.01) |

(52) U.S. Cl.

CPC ..... *H01Q 21/22* (2013.01); *H01Q 13/18* (2013.01); *H01Q 21/0075* (2013.01)

(58) Field of Classification Search

CPC .. H01Q 21/064; H01Q 13/085; H01Q 13/106; H01Q 21/0025; H01Q 21/0081; H01Q 13/08; H01Q 21/06; H01Q 21/061; H01Q 21/062; H01Q 9/28

See application file for complete search history.

(56) References Cited

U.S. PATENT DOCUMENTS

| | | | | |
|---|---|---|---|---|
| 8,350,767 | B2 | 1/2013 | Brigham et al. | |
| 9,912,072 | B1 * | 3/2018 | Mandeville | H01Q 3/46 |
| 10,193,237 | B1 | 1/2019 | Brigham | |
| 2005/0007286 | A1 | 1/2005 | Trott et al. | |
| 2009/0322636 | A1 | 12/2009 | Brigham et al. | |
| 2011/0057852 | A1 | 3/2011 | Holland et al. | |

OTHER PUBLICATIONS

International Search Report and Written Opinion dated May 23, 2019 in corresponding PCT application No. PCT/US19/20047.

* cited by examiner

*Primary Examiner* — Monica C King

(74) *Attorney, Agent, or Firm* — Nields, Lemack & Frame, LLC

(57) ABSTRACT

In this novel geometry, the 3D radiator unit cell has been designed with flat sided unit cells. Each 3D radiator unit cell incorporates a curf border of sacrificial material. This border permits independent sub-array size and shape. It also allows a gap between sub-arrays while retaining contiguous unit cell spacing giving flexibility to array size, shape and line replaceable unit capabilities.

20 Claims, 8 Drawing Sheets

DUAL POLARIZED NOTCH ANTENNA HAVING LOW PROFILE STRIPLINE FEED

This invention was made with Government support under Grant No. FA8702-15-D-0001 awarded by the U.S. Air Force. The Government has certain rights in the invention.

FIELD

This disclosure relates to arrays of dual polarized notch, tapered, and flared slot radiating antennas having a low profile stripline feed (LPSF).

BACKGROUND

Array antennas are used for a variety of different applications. Array antennas may be constructed using a plurality of three-dimensional (3D) antennas. These arrays are typically configured as a rectangular lattice but other geometries are also possible. Additionally, these antennas may be used separately, and not as part of an array. In certain embodiments, the 3D antennas may comprise notch antenna elements. The term "notch antenna" is intended to include tapered and flared elements, such that the shape is not limited by this disclosure.

Each notch antenna element includes an electrically conductive body, referred to as a notch radiator element, which has a slot. The slot separates the notch radiator element into two prongs. One of the prongs may be grounded while the other prong is energized by an RF signal in communication with a LPSF. In general, the energized prong conveys energy from a feed port into free space or air, or visa-versa. The feed port may have a characteristic impedance relative to the system impedance for maximum power transfer. The propagating signal leaving the feed port is in communication with a LPSF, coupling RF energy into the tuned gap between the energized prong and the other prong. This gap is optimized along with an RF cavity and other dimensions to result in wideband and wide scan operation. The propagating signal conveys energy into the notch slot and then into free space or air. The antenna feed port may convey energy to and from the antenna system at its characteristic impedance. Between this feed port and the radiating element are a variety of possible architectures creating a characteristic impedance match over the desired operational frequency band. For example, in certain embodiments, a printed circuit board (PCB) may be used to carry the propagating signal. In other embodiments, a PCB may not be used. For example, foam, air, another material not typically used for PCB fabrication, or some combination thereof may be used.

These notch antennas may be combined to form wideband, wide scan phased array systems. Wideband low loss phased array systems are desired in the cellular, telemetry and military applications. Use of this technology in these areas allow greater flexibility in achieving compact, lower cost, higher performance designs.

To create a dual polarized phased array, these notch antennas may be arranged in two orthogonal directions creating a sub-array. Wideband, wide scan volume, dual polarized sub-arrays using a tile format with LPSF architecture have proven difficult to integrate into a larger phased array due to non-flat sub-array edges.

Therefore, it would be beneficial if there were a dual polarized notch antenna that could be used as a unit cell, such that a wideband, wide scan volume, dual polarized phased array of any desired rectangular or square lattice size may be constructed using this unit cell. Further, it would be advantageous if this system was also cost effective, robust, lighter weight, relatively easy to manufacture, retained a lower profile and offered a line replaceable unit (LRU) option while retaining contiguous unit cell spacing.

SUMMARY

In this novel geometry, the 3D radiator unit cell has been designed with flat sided unit cells. Each 3D radiator unit cell incorporates a curf border of sacrificial material. This border permits independent sub-array size and shape. It also allows a gap between sub-arrays while retaining contiguous unit cell spacing giving flexibility to array size, shape and line replaceable unit capabilities.

In one embodiment, a 3D radiator unit cell for use in an antenna array is disclosed. The 3D radiator unit cell comprises a first notch antenna comprising a first energized prong and a first grounded prong, separated by a first gap; a second notch antenna comprising a second energized prong and a second grounded prong, separated by a second gap; wherein a longer dimension of the prongs of the first notch antenna extends in an X direction and is orthogonal to a longer dimension of the prongs of the second notch antenna, which extends in a Y-direction; wherein the longer dimension of the prongs of the first notch is parallel to the first sides and the longer dimension of the prongs of the second notch antenna is parallel to the second sides. In some embodiments, the unit cell further comprises a first RF cavity, proximate the first gap, and a second RF cavity proximate the second gap, where no conductive material is disposed in the first RF cavity or the second RF cavity. In certain embodiments, each RF cavity is rectangular in shape. In certain embodiments, sides of each RF cavity are parallel to the first and second sides. In certain embodiments, there is a non-zero distance $D_X$ in the X direction between a side of the first RF cavity nearest the second RF cavity in the X direction and a side of the second RF cavity nearest the first RF cavity and a non-zero distance $D_Y$ in the Y direction between a side of the first RF cavity nearest the second RF cavity in the Y direction and a side of the second RF cavity nearest the first RF cavity.

According to another embodiment, an antenna element is disclosed, where the antenna element comprises the 3D radiator unit cell and a printed circuit board disposed beneath the 3D radiator unit cell. In some embodiments, the printed circuit board comprises a top conductive layer, an intermediate conductive layer and a bottom conductive layer, and a low profile stripline feed is disposed between the top conductive layer and the intermediate conductive layer to carry an RF signal to a respective energized prong.

According to another embodiment, an antenna array is disclosed. This antenna array is made up of a plurality of the antenna elements, the plurality of antenna elements are disposed adjacent to one another in the antenna array; and wherein a space exists between each set of adjacent antenna elements.

According to another embodiment, an antenna array is disclosed. This antenna array is made up of a plurality of 3D radiator unit cells are integrated into a single block of conductive material, and each 3D radiator unit cell has a rectangular shape with two first sides and two second sides, and comprises: a first notch antenna comprising a first energized prong and a first grounded prong, separated by a first gap; a second notch antenna comprising a second energized prong and a second grounded prong, separated by a second gap; wherein a longer dimension of the prongs of the first notch antenna extends in an X direction and is orthogonal to a longer dimension of the prongs of the second notch antenna, which extends in a Y-direction; and wherein the longer dimension of the prongs of the first notch is parallel to the first sides and the longer dimension of the prongs of the second notch antenna is parallel to the second sides. In certain embodiments, the antenna array has a rectangular shape and the plurality of 3D radiator unit cells are arranged in an array. In certain embodiments, a printed circuit board is disposed beneath the antenna array. In certain embodiments, each 3D radiator unit cell further comprises a first rectangular RF cavity, proximate the first gap, and a second rectangular RF cavity proximate the second gap, where no conductive material is disposed in the first RF cavity or the second RF cavity; wherein the sides of each RF cavity are parallel to the first and second sides; wherein there is a non-zero distance $D_X$ in the X direction between a side of the first RF cavity nearest the second RF cavity in the X direction and a side of the second RF cavity nearest the first RF cavity and there is a non-zero distance $D_Y$ in the Y direction between a side of the first RF cavity nearest the second RF cavity in the Y direction and a side of the second RF cavity nearest the first RF cavity. In some embodiments, a curf region is defined within the non-zero distance $D_X$ and the non-zero distance $D_Y$.

According to another embodiment, an antenna sub-array is disclosed. The antenna sub-array is formed by cutting the antenna array described above along at least one curf region to create a rectangular array having fewer than the plurality of 3D radiator unit cells.

According to another embodiment, an antenna array is disclosed. The antenna array comprises a plurality of antenna sub-arrays, wherein each antenna sub-array has a rectangular shape and comprises a plurality of the 3D radiator unit cells, wherein the plurality of 3D radiator unit cells are integrated into a single block of conductive material, and each 3D radiator unit cell has a rectangular shape with two first sides and two second sides, and comprises: a first notch antenna comprising a first energized prong and a first grounded prong, separated by a first gap; a second notch antenna comprising a second energized prong and a second grounded prong, separated by a second gap; wherein a longer dimension of the prongs of the first notch antenna extends in an X direction and is orthogonal to a longer dimension of the prongs of the second notch antenna, which extends in a Y-direction; and wherein the longer dimension of the prongs of the first notch is parallel to the first sides and the longer dimension of the prongs of the second notch antenna is parallel to the second sides; and wherein the antenna sub-arrays are disposed adjacent to one another in the antenna array; and wherein a space exists between each set of adjacent antenna sub-arrays. In some embodiments, the space is filled with conductive or non-conductive pliable or flexible material. In certain embodiments, a printed circuit board is disposed beneath each of the plurality of antenna arrays, wherein the printed circuit board comprises a top conductive layer, an intermediate conductive layer and a bottom conductive layer, and a low profile stripline feed is disposed between the top conductive layer and the intermediate conductive layer to carry an RF signal to a respective energized prong.

BRIEF DESCRIPTION OF THE DRAWINGS

For a better understanding of the present disclosure, reference is made to the accompanying drawings, which are incorporated herein by reference and in which.

DETAILED DESCRIPTION

Figure 1:
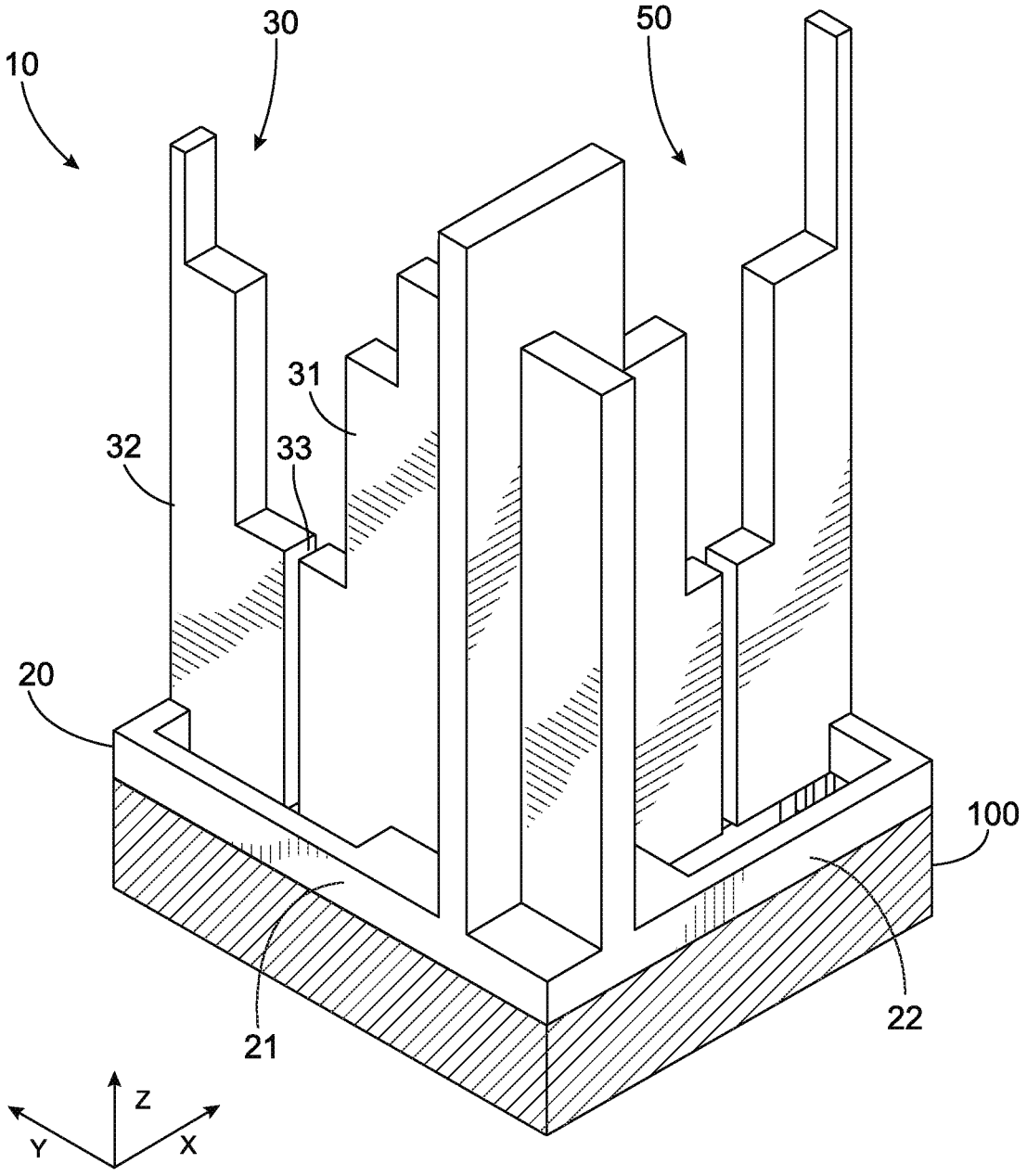
FIG. 1 shows a perspective view of a three-dimensional (3D) radiator unit cell on a printed circuit board.

FIG. 1 shows a 3D radiator unit cell 10 for a dual polarized antenna array. The 3D radiator unit cell 10 is comprised of a conductive material, such as a metal. The 3D radiator unit cell 10 may be a single block of metal in certain embodiments. For example, the 3D radiator unit cell 10 may be a solid block of aluminum or another metal. In certain embodiments, other materials that are coated or plated with a conductive material may be used. Additionally, additive manufacturing allowing the mixing of plastic, dielectric materials and various conductive materials may also be used. The 3D radiator unit cell 10 may be part of a much larger array, comprising a plurality of 3D radiator unit cells 10. The 3D radiator unit cell 10 is rectangular in shape, having first sides 21 and second sides 22, perpendicular to the first sides 21. In certain embodiments, the 3D radiator unit cell 10 may be square.

Each 3D radiator unit cell 10 comprises two notch antennas, oriented in orthogonal directions. For purposes of illustration, these two directions are referred to as the X direction and the Y direction. These two notch antennas will be referred to as the first notch antenna 30 and the second notch antenna 50. The first notch antenna 30 may be configured as the horizontally polarized antenna, while the second notch antenna 50 may be configured as the vertically polarized antenna. In other words, the first notch antenna 30 extends in the X direction, while the second notch antenna 50 extends in the Y direction. In other words, the longer dimension of the prongs of the first notch antenna 30 extends in the X direction and is parallel to first side 21. Similarly, the longer dimension of the prongs of the second notch antenna 50 extends in the Y direction and is parallel to second side 22.

The 3D radiator unit cell 10 includes a base 20, from which the first notch antenna 30 and the second notch antenna 50 extend upward in the height (or Z) direction. The base 20 rests on a printed circuit board (PCB) 100, which is described in more detail below. The base 20 may be a fixed thickness, with the prongs of the antennas extending upward from that thickness. In certain embodiments, this thickness may be selected so as to optimally tune the array.

The first notch antenna 30 comprises a first energized prong 31 and a first grounded prong 32 are separated by a first gap 33 therebetween. The first gap 33 extends upward in the height (or Z) direction between the first energized prong 31 and the first grounded prong 32 such that the two prongs never contact one another. The first gap 33 separates the first energized prong 31 and the first grounded prong 32 in the X direction. Note that the space between the first energized prong 31 and the first grounded prong 32 may vary as a function of height. For example, the prongs may be stepped so that the width of the first gap 33 increases as the height of the prongs increases. In certain embodiments, the edges of the prongs that face the first gap 33 may be parallel to one another. However, in other embodiments, such as flared prongs, these edges may not be parallel to one another.

While the figures show the first energized prong 31 to the right of the first grounded prong 32, other embodiments are possible. For example, the first energized prong 31 may be to the left of the first grounded prong 32. However, once defined, the feed polarity should remain symmetrically oriented across the entire array of 3D radiator unit cells 10.

Figure 2:
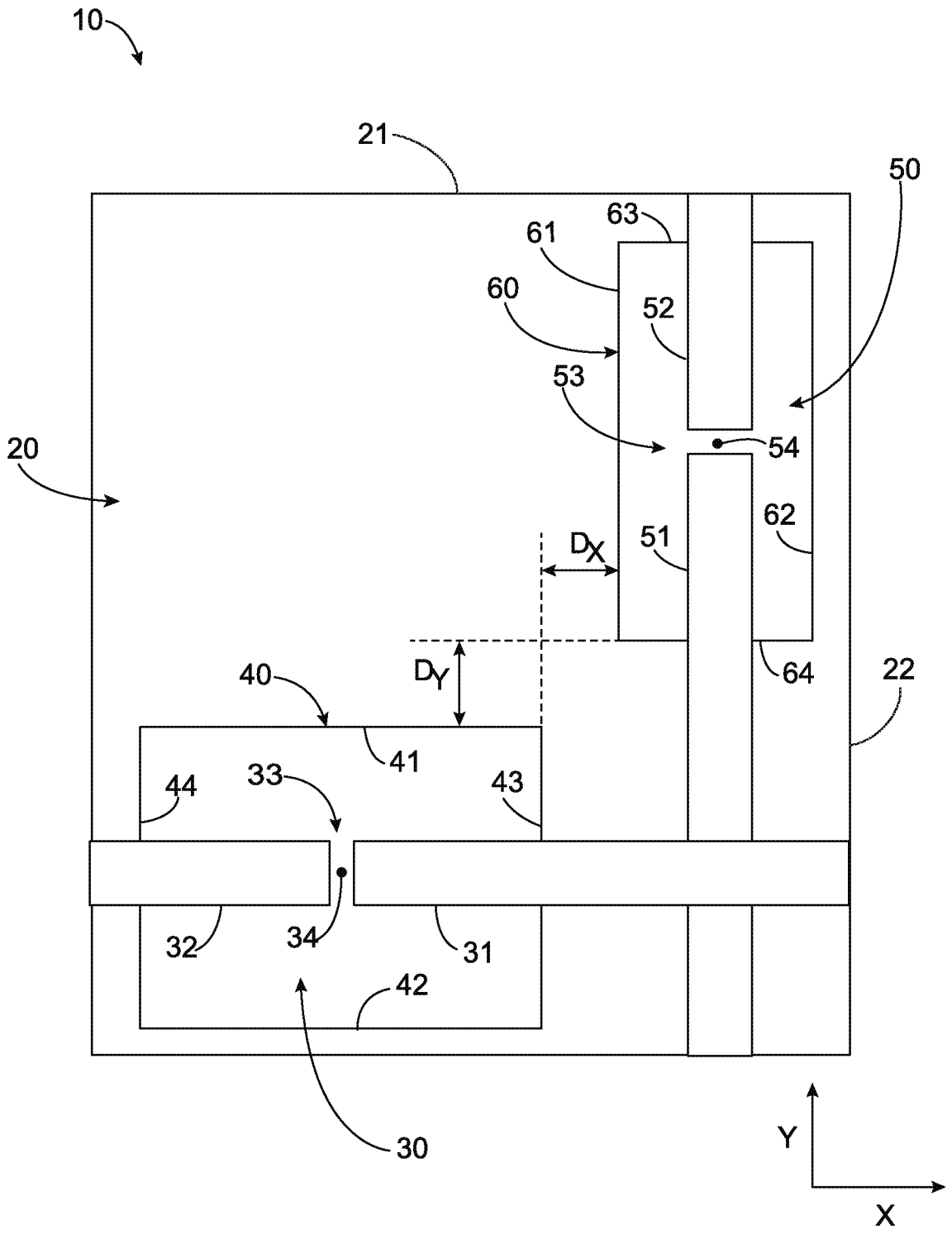
FIG. 2 shows a top view of the 3D radiator unit cell of FIG. 1.

FIG. 2 shows a first opening in the 3D radiator unit cell for the first RF cavity 40, located proximate to the first gap 33 and includes the first gap 33, as well as portions of the first energized prong 31 and the first grounded prong 32. The first RF cavity 40 is a volume with no conductive material. In some embodiments, a dielectric material, such as air, foam or another material, may be disposed in this volume. In certain embodiments, the outline of the first RF cavity 40 may be a rectangular shape, having two pairs of opposite sides. In certain embodiments, sides 41, 42 are parallel to first side 21 and sides 43, 44 are parallel to second side 22. In other embodiments, the outline of the first RF cavity 40 may be another shape, such as an oval, hexagon, octagon, or other shape. The first energized prong 31 extends into the first RF cavity 40 from the side 43. The first grounded prong 32 extends into the first RF cavity 40 from the side 44. Each prong may extend the same distance into the first RF cavity 40 from its respective side. The midpoint 34 of the first gap 33 may be the same distance from side 41 and side 42. Similarly, the midpoint 34 of the first gap 33 may be the same distance from the side 43 and the side 44. In some embodiments, the dimensions of the first RF cavity 40 are selected to achieve acceptable impedance matching over a wide bandwidth and scan volume. The first RF cavity 40 comprises a region on the 3D radiator unit cell 10 that is devoid of any conductive material.

However, in other embodiments, one prong may extend a different distance into the first RF cavity 40 than the other prong. This may be done based on manufacturing requirements or sub-array assembly requirements only along the parting sub-array edge.

The second notch antenna 50 comprises a second energized prong 51 and a second grounded prong 52 are separated by a second gap 53 therebetween. The second gap extends upward in the height (or Z) direction between the second energized prong 51 and the second grounded prong 52 such that the two prongs never contact one another. The second gap 53 separates the second energized prong 51 and the second grounded prong 52 in the Y direction. Note that the space between the second energized prong 51 and the second grounded prong 52 may vary as a function of height. For example, the prongs may be stepped so that the width of the second gap 53 increases as the height of the prongs increases.

A second opening in the 3D radiator unit cell for second RF cavity 60 is located proximate the second gap 53 and includes the second gap 53, as well as portions of the second energized prong 51 and the second grounded prong 52. The second RF cavity 60 is a volume with no conductive material. In some embodiments, a dielectric material, such as air, foam or another material, may be disposed in this volume. In certain embodiments, the outline of the second RF cavity 60 may be a rectangular shape, having two pairs of opposite sides. In certain embodiments, sides 63, 64 are parallel to first side 21 and sides 61, 62 are parallel to second side 22. In other embodiments, the outline of the second RF cavity 60 may be another shape, such as an oval, hexagon, octagon, or other shape. As was described above, the second energized prong 51 extends into the second RF cavity 60 from side 64 of the second RF cavity 60. The second grounded prong 52 extends into the second RF cavity 60 from an opposite side 63. Each prong may extend the same distance into the second RF cavity 60 from its respective side. The midpoint 54 of the second gap 53 may be the same distance from side 61 and side 62. Similarly, the midpoint 54 of the second gap 53 may be the same distance from the side 63 and the side 64. In some embodiments, the dimensions of the second RF cavity 60 are selected to achieve acceptable impedance matching over a wide bandwidth and scan volume. The second RF cavity 60 comprises a region on the 3D radiator unit cell 10 that is devoid of any conductive material.

However, in other embodiments, one prong may extend a different distance into the second RF cavity 60 than the other prong. This may be done based on manufacturing requirements or sub-array assembly requirements only along the parting sub-array edge.

It is noted that, in certain embodiments, the first RF cavity 40 and the second RF cavity 60 may have the same dimensions. However, in other embodiments, the first RF cavity 40 and the second RF cavity 60 may be of different shapes and/or sizes.

There is a non-zero distance $D_X$ in the X direction between the side 43 of the first RF cavity 40 and the side 61 of the second RF cavity 60. Similarly, there is a non-zero distance $D_X$ in the X direction between the side 44 of the first RF cavity 40 and the side 62 of the second RF cavity 60, which is located in the adjacent unit cell.

There is a non-zero distance $D_Y$ in the Y direction between the side 41 of the first RF cavity 40 and the side 64 of the second RF cavity 60. Similarly, there is a non-zero distance $D_Y$ in the Y direction between the side 42 of the first RF cavity 40 and the side 63 of the second RF cavity 60, which is located in the adjacent unit cell.

Figure 3:
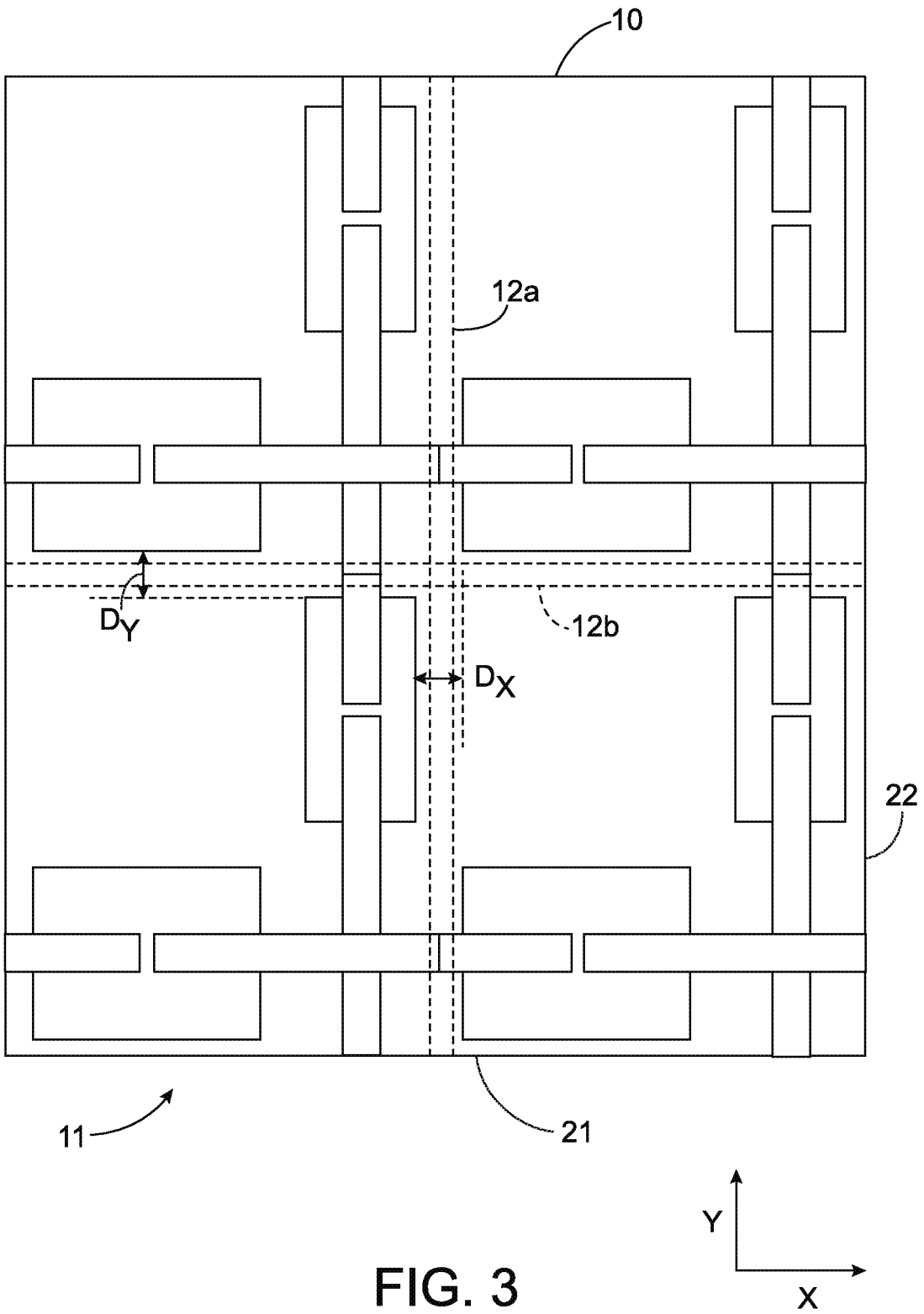
FIG. 3 shows a top view of a larger base having a plurality of 3D radiator unit cells with curf regions.

In certain embodiments, such as that shown in FIG. 3, a large base 11, comprising a plurality of integral unit cells 10, may be constructed. This is referred to as an antenna array or sub-array if used within a larger array. In certain embodiments, an array or sub-array comprises a plurality of 3D radiator unit cells that are integrated into a single block of conductive material, such as a single metal block. These non-zero distances $D_X$ and $D_Y$ allow the large base 11 to be machined or otherwise divided to conform to a desired dimension for sub-array use. For example, the distances $D_X$ and $D_Y$ provide the curf regions 12*a*, 12*b* along which the larger base 11 may be cut to create a base having a smaller number of unit cells 10. The curf regions 12*a*, 12*b* are defined as regions disposed within the $D_X$ and $D_Y$ distances, respectively. Typically, the curf region is defined so that it is centered in the respective $D_X$ or $D_Y$ distance. In other words, the center of the curf regions 12*a*, 12*b* corresponds to the midpoint of $D_X$ and $D_Y$, respectively. The width of the curf regions 12*a*, 12*b* is less than the distances $D_X$ and $D_Y$, respectively.

As stated above, the curf region 12*a*, 12*b* allows an antenna array to be divided into smaller sub-arrays. For example, a cut along curf region 12*b*, allows the larger base 11 (i.e. the antenna array) to be divided into two smaller bases (i.e. sub-arrays), each comprising exactly two unit cells. A similar result may be achieved by cutting along curf region 12*a*. Note that the $D_X$ and $D_Y$ distances are defined so that cuts along the curf regions 12*a*, 12*b* do not interfere with the RF cavities 40, 60. In addition, Dx and Dy are larger than the curf regions so as to leave adequate material along the radiator edge and PCB edge after cutting for structural integrity, fabrication and assembly purposes.

Note that due to the inventive configuration of the 3D radiator unit cell 10, the larger base 11 (i.e. the array), even after being cut, is still a regular shape, which make manufacturing of the associated printed circuit board much simpler and more economical. A regular shape is one with flat edges along a rectangular lattice. These flat edges are parallel to the longer dimensions of the prongs. Therefore, a regular shape does not include a sawtooth edge profile. Importantly, the resulting base (i.e. a sub-array), that is obtained after cutting along the curf regions, has flat edges. The flat sides of the array and the sub-array are achievable because the borders of the RF cavities 40, are within the boundaries of the defined 3D radiator unit cell dimensions. Unit cell dimensions are small enough to achieve wide scan angles and wide bandwidth but large enough to allow sacrificial curf material when defining a sub-array. The sub-array size that is achieved is independent, allowing any rectangular or square sized shapes.

In addition to the ability to divide a larger base 11 (i.e. array) into one or more smaller bases (i.e. sub-arrays), each comprising one or more 3D radiator unit cells, the inventive configuration of the 3D radiator unit cell allows other opportunities. In one embodiment, a larger array may be comprised of a plurality of separate 3D radiator unit cells. These separate unit cells can be assembled to form any desired rectangular or square lattice size. In certain embodiments, multiple unit cells are abutted together producing a flat sided array. However, in other embodiments, a space, which may be equal to the width of the curf region, is disposed between adjacent 3D radiator unit cells. This space may be air, or may be filled with a conductive or non-conductive material.

Figure 4A:
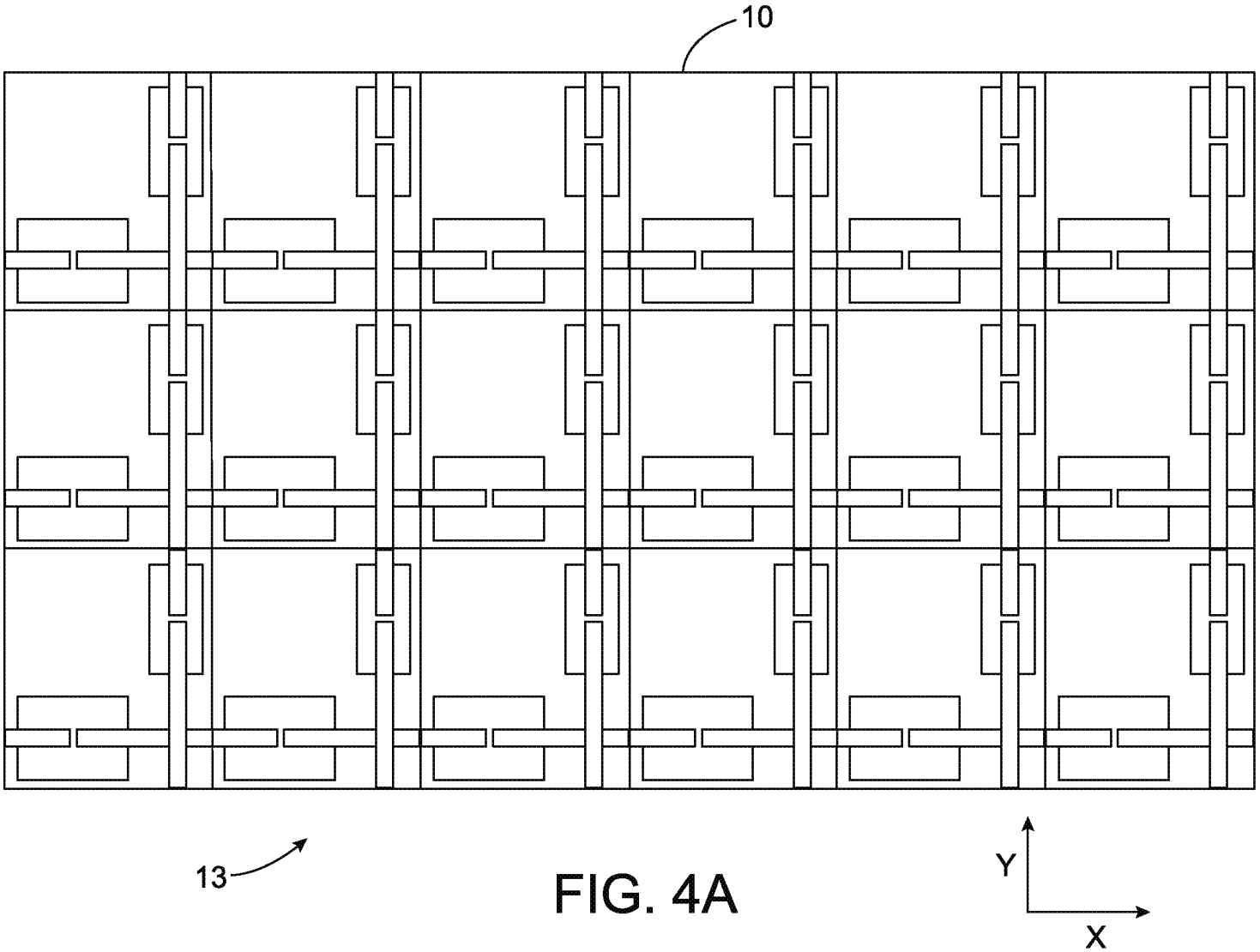
FIG. 4A shows a top view of a larger 6×3 base that is created by assembling a plurality of 3D radiator unit cells along both the x-axis and y-axis as a rectangular lattice.

In another embodiment, as shown in FIG. 4A, a plurality of 3D radiator unit cells 10 may be placed adjacent to one another to form a large base 13 (i.e. array). In this embodiment, 18 unit cells 10 are disposed in a configuration with 6 unit cells in the X direction and 3 unit cells in the Y direction. Of course, the unit cells can be assembled to form any desired rectangular or square lattice size. Again, because the unit cell is rectangular in shape, it is possible to easily abut multiple unit cells together producing a flat sided array. However, in other embodiments, a space, which may be equal to the width of the curf region, is disposed between adjacent 3D radiator unit cells. This space may be air, or may be filled with a conductive or non-conductive material.

Larger bases may also be created using sub-arrays. A sub-array is a single base that is made up of a plurality of integral 3D radiator unit cells. For example, FIG. 3 shows a 2×2 sub-array that comprises two 3D radiator units cells in both the X and Y directions.

Figure 4B:
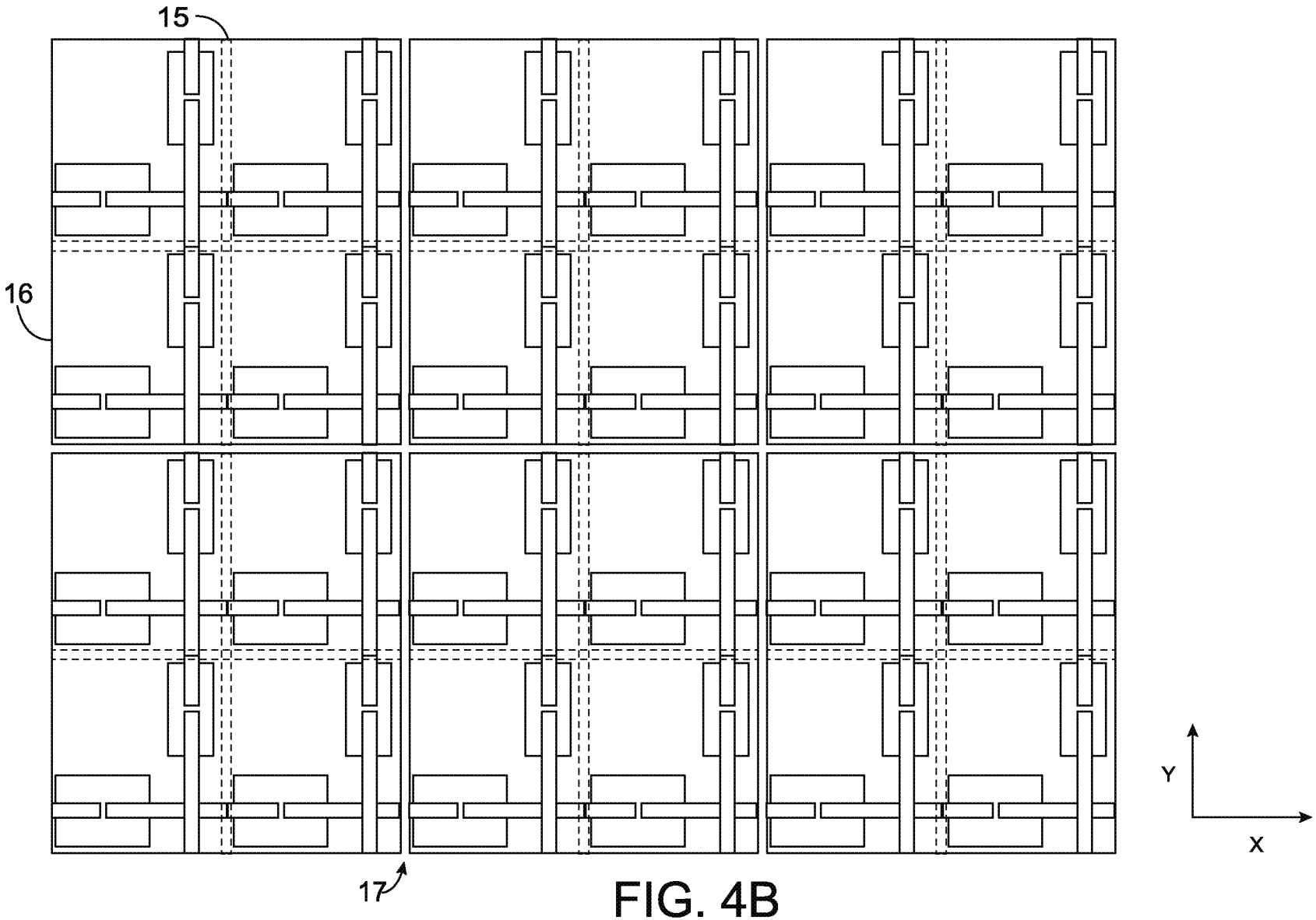
FIG. 4B shows a top view of a larger 6×4 base that is created by assembling a plurality of smaller sub-arrays along both the x-axis and the y-axis.

FIG. 4B shows an array built using a plurality of 2×2 sub-arrays 16, such as that shown in FIG. 3. Dotted lines on each 2×2 sub-array 16 show the curf regions. Note that adjacent sub-arrays 16 are separated by a separation distance 17 equal to the curf region. In this way, the 3D radiator unit cell spacing is the same, regardless of whether the unit cells are on the same sub-array 16 or different sub-arrays. As described above, the separation distance 17 equal to the curf region between adjacent sub-arrays 16 may be air, or may be filled with a conductive or non-conductive material.

In this way, Line Replaceable Units (LRUs) may be created. If, for any reason, one of the sub-arrays 16 becomes faulty or inoperable, that sub-array 16 may be removed from the array. A new or repaired sub-array 16 can then replace it, and the prongs of the new sub-array may be electrically connected to the adjacent prongs, as described below.

The 3D radiator unit cell with LPSF and flat sides are used to create a sub-array tile architecture having LRU capabilities. This sub-array may be integrated within a larger main array using the sub-array with flat sides to cleanly fit in a square or rectangular tile format. Curf gaps between the subarrays at the PCB and radiator base can be air gaps or filled with conductive or non-conductive pliable or flexible material achieving line replicable unit LRU qualities to the sub-array. Without the curf region, the sub-arrays will be forced together at the parting edge without any account for sub-array dimensional size tolerances.

When joining adjacent sub-arrays 16, a conductive mechanical attachment method is required between the adjacent sub-array 16 prongs along the Z-axis spanning the curf gap or separation distance 17. This conduction may not be needed along the entire prong structure but may be best placed at top and another location between prong top and top surface of base 20. Placement may be determined based on EM modeling.

It should also be noted that a sub-array can be created to be arrayed in just the vertical or just the horizontal direction. For instance, a 6×1 (row x column) sub-array can be placed beside another in the X direction only. Alternatively, a 1×6 sub-array can be placed beside another in the Y direction only.

As a result, the non-parting edges of the sub-arrays will not have the curf removed and all vias in this axis are retained along the unit cell edge. It also allows the designer to ignore curf constraints along the non-parting edge axis of the unit cell in this direction. This gives more freedom to tune for higher bandwidth, scan volume and overall increased performance.

In summary, a unit cell 10 is rectangular in shape, having first sides 21 and perpendicular second sides 22. The unit cell 10 comprises a first notch antenna 30 where the longer dimension of the prongs extend in a first direction, a second notch antenna 50 where the longer dimension of the prongs extend in a second direction. A first RF cavity 40 associated with the first notch antenna 30 and a second RF cavity 60 associated with the second notch antenna 50. The first direction is parallel to the first side 21 and the second direction is parallel to the second side 22.

Figure 5A:
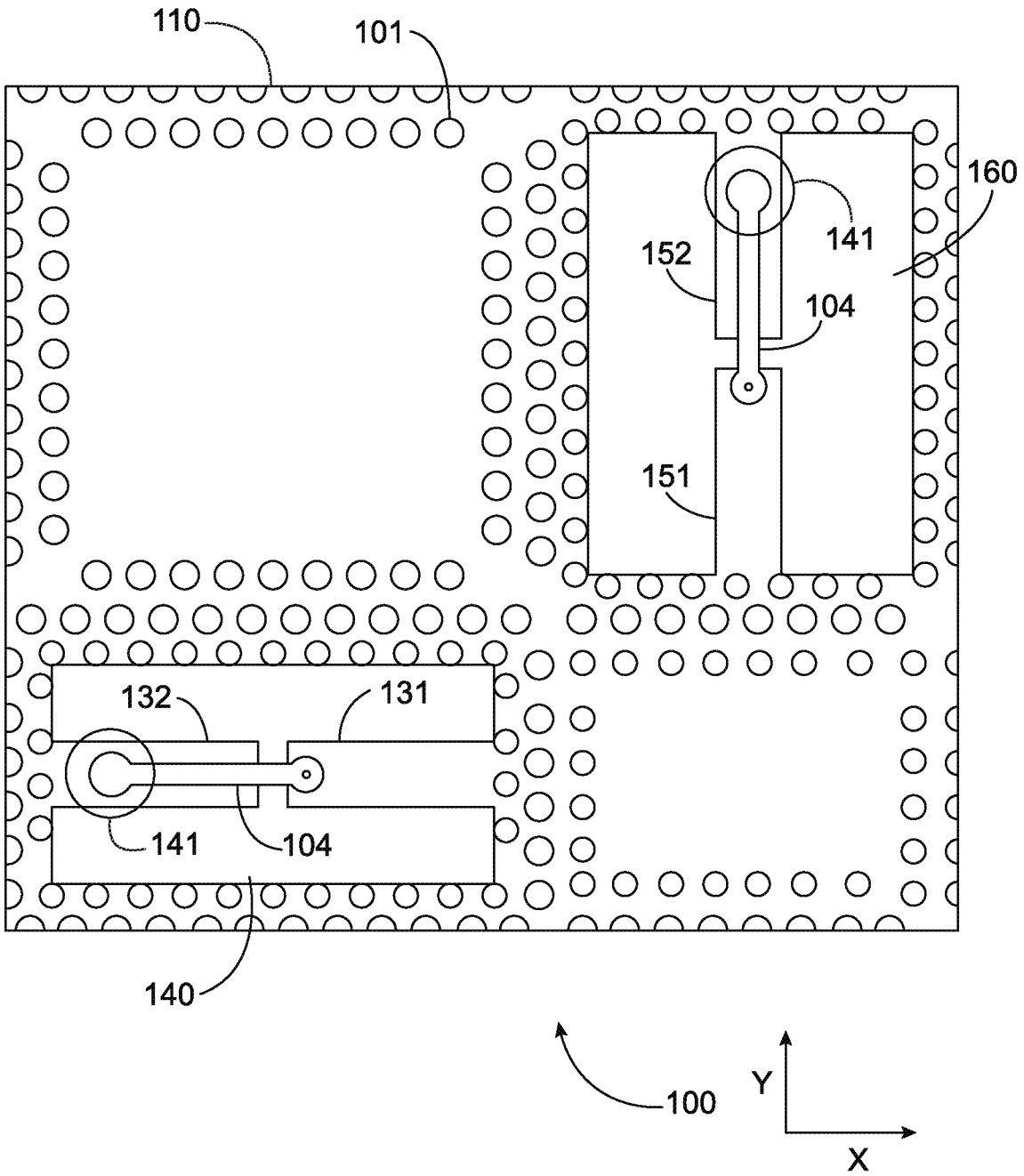
FIG. 5A is a top view of the PCB associated with a 3D radiator unit cell according to one embodiment.
Figure 5B:
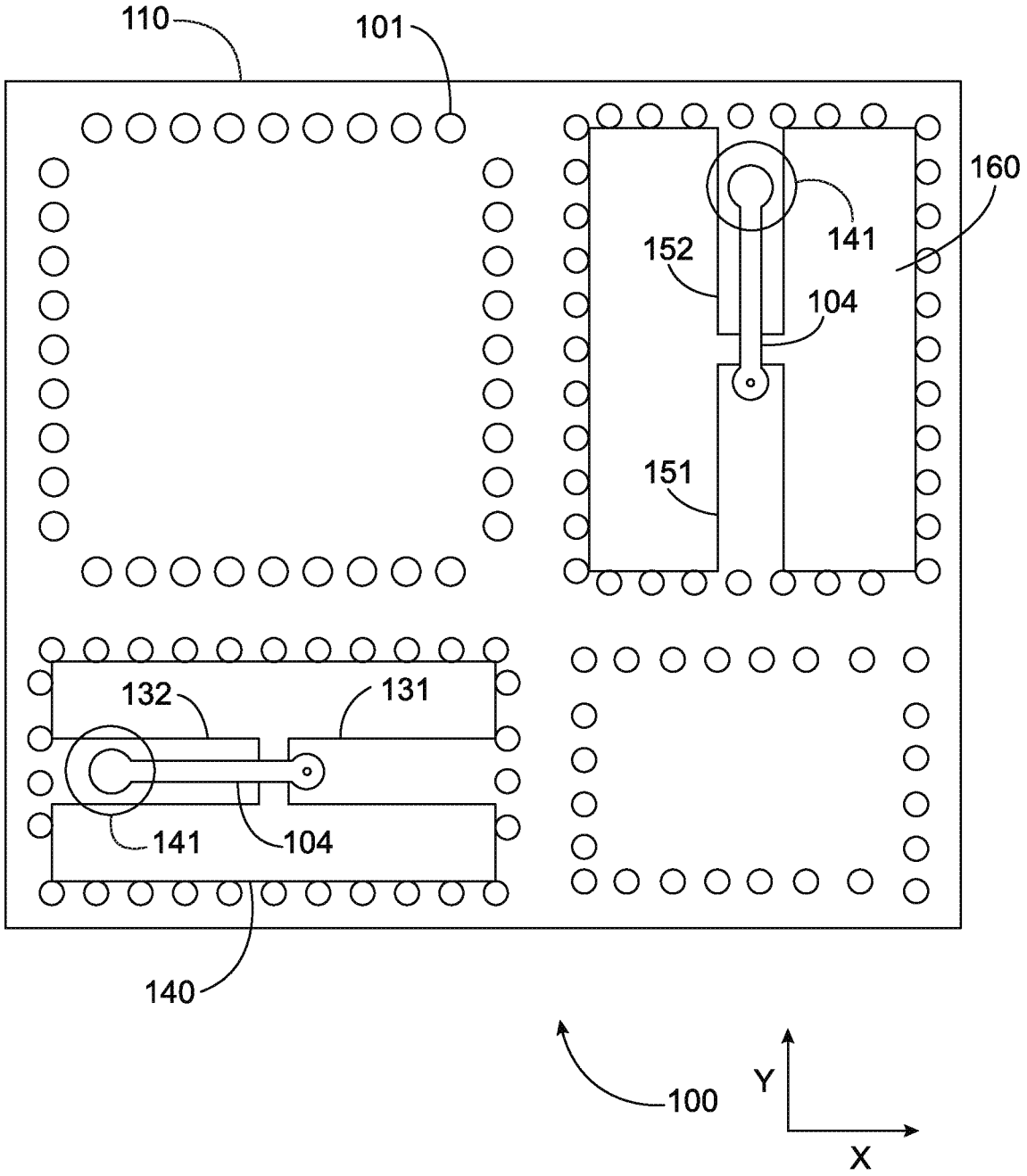
FIG. 5B is a top view of the PCB associated with a 3D radiator unit cell according to a second embodiment.
Figure 6:
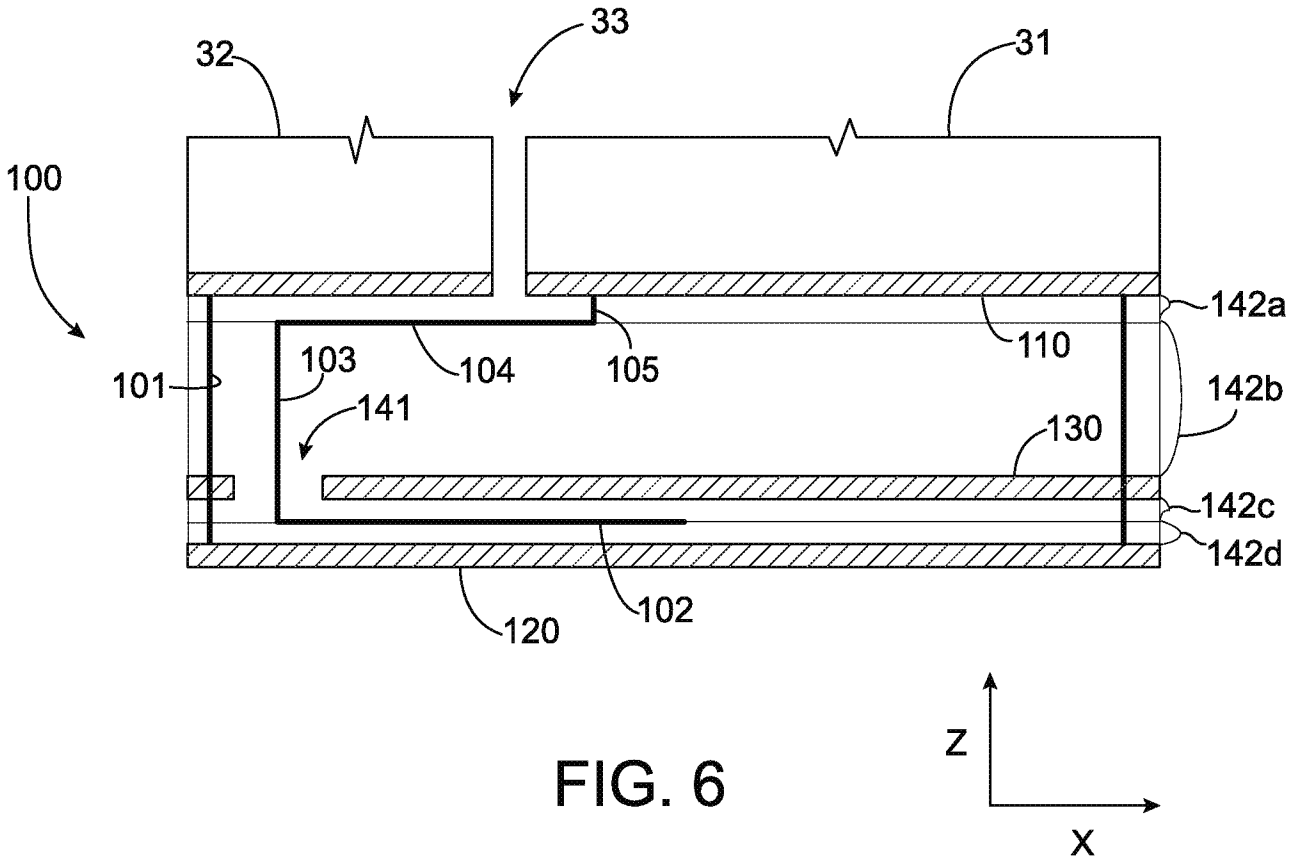
FIG. 6 shows a cross-section of the PCB taken in the X-Z plane.

FIG. 5A and FIG. 5B show a top view of the printed circuit board 100 associated with a unit cell according to two embodiments. FIG. 6 shows a cross-section of the PCB 100 taken along the X-Z plane. The PCB 100 is typically dimensioned to the size of the sub-array. In other words, if the sub-array comprises a metal block that includes a plurality of unit cells arranged in an array, the associated PCB 100 will have the same size and shape as the sub-array. Similarly, if the sub-array is a single unit cell, the PCB 100 will also have that size and shape.

Top conductive layer 110 and bottom conductive layer 120 are disposed on the upper and lower surfaces of the PCB 100, respectively. In one embodiment, the conductive layers are copper layers. The top conductive layer 110, intermediate conductive layer 130 and the bottom conductive layer 120 are electrically connected using a number of electrically conductive shorting vias 101 that pass through the PCB 100 as shown in FIG. 6. The top conductive layer 110, which is shown in FIGS. 5A-5B, may have a first open region 140 which may correspond to first RF cavity 40 and a second open region 160 that may correspond to second RF cavity 60. The open regions 140, 160 are areas where no conductive material is disposed on the first dielectric layer 142*a*. First patterned areas 131, 132 may extend into the first open region 140. The first patterned area 132 may correspond to where the first grounded prong 32 rests on the PCB 100. Similarly, the first patterned area 131 may correspond to where the first energized prong 31 rests on the PCB 100. Similarly, second patterned areas 151, 152 may extend into the second open region 160. The second patterned area 152 may correspond to where the second grounded prong 52 rests on the PCB 100. Similarly, the second patterned area 151 may correspond to where the second energized prong 51 rests on the PCB 100. The electrically conductive shorting vias 101 may be disposed along a perimeter surrounding first open region 140 and second open region 160 as shown in FIGS. 5A-5B. In certain embodiments, the layout of the shorting vias 101 may differ along curf regions. For example, the vias along the curf region may be removed, as shown in FIG. 5B. While FIG. 6 shows the shorting vias 101 passing directly from top conductive layer 110 to the bottom conductive layer 120, other embodiments are also possible. For example, hidden or blind vias may be used. If desired, additional electrically conductive shorting vias 101 may also be provided in other regions. In certain embodiments, at least one intermediate conductive layer 130 is disposed between the top conductive layer 110 and the bottom conductive layer 120. This intermediate conductive layer 130 may be a ground layer.

In the embodiment shown in FIG. 6, there may be four dielectric layers 142*a*, 142*b*, 142*c*, 142*d*. The top surface of the first dielectric layer 142*a* is the top non-conductive surface of the PCB 100 and the top conductive layer 110 is disposed on this surface. Between first dielectric layer 142*a* and second dielectric layer 142*b*, there may be a first signal layer shown as the low profile stripline feed 104. Between the second dielectric layer 142*b* and the third dielectric layer 142*c* may be an intermediate conductive layer 130. Between the third dielectric layer 142*c* and the fourth dielectric layer 142*d* may be a second signal layer shown as an RF stripline trace 102. The bottom surface of the fourth dielectric layer 142*d* is the bottom non-conductive surface of the PCB 100. The bottom conductive layer 120 may be disposed on this layer.

Electrically conductive RF signal vias are used to electrically connect an RF signal shown as an RF stripline trace 102 to the energized prongs of the first notch antenna 30 and the second notch antenna 50. The vertical RF signal via 103 may originate on the second signal layer, which is disposed between the intermediate conductive layer 130 and the bottom conductive layer 120. Alternately, this signal layer may originate between other layers below bottom conductive layer 120 within a larger multi-layer PCB. In another embodiment, such as a coplanar waveguide (CPWG) or microstrip trace, this may originate on the bottom conductive layer 120. Regardless of trace type, the vertical RF signal via 103 may pass vertically through an opening 141 in at least one intermediate conductive layer 130. The vertical RF signal via 103 attaches to make electrical communication between the RF stripline trace 102 and the low profile stripline feed (LPSF) 104, which is disposed in the first signal layer, which is between the first dielectric layer 142*a* and the second dielectric layer 142*b*. The low profile stripline feed 104 extends horizontally from the top of the vertical RF signal via 103 and is separated from the top conductive layer 110 by a non-zero distance. The low profile stripline feed 104 has a length that runs parallel to the longer dimension of the first grounded prong 32. The low profile stripline feed 104 passes under the grounded prong 32 and the first gap 33 where it is electrically coupled, terminating to the top conductive layer 110 at one end through a short vertical conductive via 105 to first energized prong 31. In addition, embedded RF cavities within the PCB 100 are volumes defined by shorting vias 101, top conductive layer 110 and intermediate conductive layer 130. No other conductive material is normally placed within these embedded RF cavities, other than the low profile stripline feeds and RF vias. In some designs, other metal can be placed within the embedded RF cavities for tuning, mechanical or system network facilitation. In some unit cells, the shorting vias 101 do not follow the exact boundaries or shape of the open regions 140, 160 formed on the top conductive layer 110. These shorting vias 101 may be in alternate patterns that may extend wider in X and Y axis than the open region 140, 160 on the top conductive layer 110. The shape and size depend on desired phased array RF bandwidth and scan volume performance.

In certain embodiments, the PCB 100 utilizes metal edge plated walls along the curf edges that define the structures for the embedded RF cavities for the sub-array feed architecture. This technique creates continuous communications between ground-plane layers and the 3D radiator. As a result, this permits non-conductive material to be used between separation distance 17 equal to the curf region between adjacent sub-arrays. This technique also permits optionally no material to be disposed between sub-arrays for frictionless removal of the sub-arrays.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. A 3D radiator unit cell for use in an antenna array, wherein the 3D radiator unit cell has a rectangular shape with two first sides and two second sides and comprises:

a first notch antenna comprising a first energized prong and a first grounded prong, separated by a first gap;

a second notch antenna comprising a second energized prong and a second grounded prong, separated by a second gap;

wherein a longer dimension of the prongs of the first notch antenna extends in an X direction and is orthogonal to a longer dimension of the prongs of the second notch antenna, which extends in a Y-direction;

wherein the longer dimension of the prongs of the first notch is parallel to the first sides and the longer dimension of the prongs of the second notch antenna is parallel to the second sides.

2. The 3D radiator unit cell of claim 1, further comprising a first RF cavity, proximate the first gap, and a second RF cavity proximate the second gap, where no conductive material is disposed in the first RF cavity or the second RF cavity.

3. The 3D radiator unit cell of claim 2, wherein each RF cavity is rectangular in shape.

4. The 3D radiator unit cell of claim 3, wherein the sides of each RF cavity are parallel to the first and second sides.

5. The 3D radiator unit cell of claim 3, where there is a non-zero distance $D_X$ in the X direction between a side of the first RF cavity nearest the second RF cavity in the X direction and a side of the second RF cavity nearest the first RF cavity.

6. The 3D radiator unit cell of claim 3, where there is a non-zero distance $D_Y$ in the Y direction between a side of the first RF cavity nearest the second RF cavity in the Y direction and a side of the second RF cavity nearest the first RF cavity.

7. An antenna element comprising the 3D radiator unit cell of claim 1, and further comprising a printed circuit board disposed beneath the 3D radiator unit cell.

8. The antenna element of claim 7, wherein the printed circuit board comprises a top conductive layer, an intermediate conductive layer and a bottom conductive layer, and a low profile stripline feed is disposed between the top conductive layer and the intermediate conductive layer to carry an RF signal to a respective energized prong.

9. The antenna element of claim 8, wherein a first and a second open region are disposed on the top conductive layer, where no conductive material is disposed and the first and second open regions correspond to the first RF cavity and second RF cavity, respectively.

10. The antenna element of claim 9, wherein shorting vias are disposed outside the first and second open regions and electrically connect the top conductive layer to the intermediate conductive layer.

11. An antenna array, comprising a plurality of the antenna elements of claim 7, wherein the plurality of antenna elements are disposed adjacent to one another in the antenna array; and wherein a space exists between each set of adjacent antenna element.

12. An antenna array, comprising a plurality of the 3D radiator unit cells, wherein the plurality of 3D radiator unit cells are integrated into a single block of conductive material, and each 3D radiator unit cell has a rectangular shape with two first sides and two second sides, and comprises:

a first notch antenna comprising a first energized prong and a first grounded prong, separated by a first gap;

a second notch antenna comprising a second energized prong and a second grounded prong, separated by a second gap;

wherein a longer dimension of the prongs of the first notch antenna extends in an X direction and is orthogonal to a longer dimension of the prongs of the second notch antenna, which extends in a Y-direction; and wherein the longer dimension of the prongs of the first notch is parallel to the first sides and the longer dimension of the prongs of the second notch antenna is parallel to the second sides.

13. The antenna array of claim 12, wherein the antenna array has a rectangular shape and the plurality of 3D radiator unit cells are arranged in an array.

14. The antenna array of claim 12, further comprising a printed circuit board disposed beneath the antenna array, wherein the printed circuit board comprises a top conductive layer, an intermediate conductive layer and a bottom conductive layer, and a low profile stripline feed is disposed between the top conductive layer and the intermediate conductive layer to carry an RF signal to a respective energized prong.

15. The antenna array of claim 12, wherein each 3D radiator unit cell further comprises:

a first rectangular RF cavity, proximate the first gap, and a second rectangular RF cavity proximate the second gap, where no conductive material is disposed in the first RF cavity or the second RF cavity;

wherein the sides of each RF cavity are parallel to the first and second sides; wherein there is a non-zero distance $D_X$ in the X direction between a side of the first RF cavity nearest the second RF cavity in the X direction and a side of the second RF cavity nearest the first RF cavity and there is a non-zero distance $D_Y$ in the Y direction between a side of the first RF cavity nearest the second RF cavity in the Y direction and a side of the second RF cavity nearest the first RF cavity.

16. The antenna array of claim 15, further comprising a curf region defined within the non-zero distance $D_X$ and the non-zero distance $D_Y$.

17. An antenna sub-array formed by cutting the antenna array of claim 16, along at least one curf region to create a rectangular array having fewer than the plurality of 3D radiator unit cells.

18. An antenna array, comprising a plurality of antenna sub-arrays, wherein each antenna sub-array has a rectangular shape and comprises a plurality of the 3D radiator unit cells, wherein the plurality of 3D radiator unit cells are integrated into a single block of conductive material, and each 3D radiator unit cell has a rectangular shape with two first sides and two second sides, and comprises:

a first notch antenna comprising a first energized prong and a first grounded prong, separated by a first gap;

a second notch antenna comprising a second energized prong and a second grounded prong, separated by a second gap;

wherein a longer dimension of the prongs of the first notch antenna extends in an X direction and is orthogonal to a longer dimension of the prongs of the second notch antenna, which extends in a Y-direction; and wherein the longer dimension of the prongs of the first notch is parallel to the first sides and the longer dimension of the prongs of the second notch antenna is parallel to the second sides;

and wherein the antenna sub-arrays are disposed adjacent to one another in the antenna array; and wherein a space exists between each set of adjacent antenna sub-arrays.

19. The antenna array of claim 18, wherein the space is filled with conductive or non-conductive pliable or flexible material.

20. The antenna array of claim 18, further comprising a printed circuit board disposed beneath each of the plurality of antenna arrays, wherein the printed circuit board comprises a top conductive layer, an intermediate conductive layer and a bottom conductive layer, and a low profile stripline feed is disposed between the top conductive layer and the intermediate conductive layer to carry an RF signal to a respective energized prong.

* * * * *